US011236879B2

(12) United States Patent
Zhang

(10) Patent No.: US 11,236,879 B2
(45) Date of Patent: Feb. 1, 2022

(54) VEHICLE LAMP SYSTEM, VEHICLE LAMP, AND METHOD FOR MANUFACTURING VEHICLE LAMP SYSTEM

(71) Applicant: HASCO VISION TECHNOLOGY CO., LTD., Shanghai (CN)

(72) Inventor: Jie Zhang, Shanghai (CN)

(73) Assignee: Hasco Vision Technology Co., Ltd., Shanghai (CN)

( * ) Notice: Subject to any disclaimer, the term of this patent is extended or adjusted under 35 U.S.C. 154(b) by 0 days.

(21) Appl. No.: 16/063,978

(22) PCT Filed: May 4, 2018

(86) PCT No.: PCT/CN2018/085661

§ 371 (c)(1),
(2) Date: Jun. 19, 2018

(87) PCT Pub. No.: WO2019/157781

PCT Pub. Date: Aug. 22, 2019

(65) Prior Publication Data

US 2021/0199260 A1 Jul. 1, 2021

(30) Foreign Application Priority Data

Feb. 13, 2018 (CN) ..... 201810150455.X

(51) Int. Cl.
*F21S 41/33* (2018.01)
*F21S 41/25* (2018.01)
(Continued)

(52) U.S. Cl.
CPC ..... *F21S 41/337* (2018.01); *F21S 41/153* (2018.01); *F21S 41/25* (2018.01); *F21S 41/37* (2018.01);
(Continued)

(58) Field of Classification Search
CPC ..... F21S 41/337; F21S 41/25; F21S 41/37; F21S 41/153; F21S 41/141; F21S 43/14;
(Continued)

(56) References Cited

U.S. PATENT DOCUMENTS 4,814,960 A * 3/1989 Liu ..... F21V 3/04 362/307
5,386,347 A 1/1995 Matsumoto
(Continued)

FOREIGN PATENT DOCUMENTS

CN 101975372 2/2011
CN 102788302 11/2012
(Continued)

OTHER PUBLICATIONS

International Search Report & Written Opinion of International Application No. PCT/CN2018/085661 dated Nov. 20, 2018 in 12 pages.
(Continued)

*Primary Examiner* — Peggy A Neils
(74) *Attorney, Agent, or Firm* — Knobbe Martens Olson & Bear, LLP

(57) ABSTRACT

A vehicle lamp system, a vehicle lamp, and a method for manufacturing a vehicle lamp system relating to the technical field of automobile lamps/lighting are provided. In one implementation, the vehicle lamp system may comprise a light reflective element and at least one light source, with the light source(s) disposed opposite to the light reflective element, wherein the light reflective element is configured to reflect light emitted from the light source in a diffuse manner to achieve uniform illumination. Vehicle lamp systems and the vehicle lamps provided in accordance with the disclosed technology may possess the advantage of better light uniformity.

14 Claims, 4 Drawing Sheets

(51) Int. Cl.

| | |
|---|---|
| ***F21S 41/37*** | (2018.01) |
| ***F21S 41/153*** | (2018.01) |
| ***F21V 7/00*** | (2006.01) |
| ***F21Y 115/10*** | (2016.01) |
| ***F21K 9/90*** | (2016.01) |

(52) U.S. Cl.
CPC ..... *F21V 7/0083* (2013.01); *F21K 9/90* (2013.01); *F21Y 2115/10* (2016.08)

(58) Field of Classification Search
CPC ..... F21S 43/33; F21S 41/147; F21V 7/0083; F21V 7/0008; F21V 7/22; F21V 7/048; F21Y 2115/10; F21K 9/90
See application file for complete search history.

(56) References Cited

U.S. PATENT DOCUMENTS

| | | | | |
|---|---|---|---|---|
| 6,200,399 | B1 * | 3/2001 | Thielman | B29C 59/022 156/209 |
| 7,374,300 | B2 * | 5/2008 | Mehrtens | F21V 7/28 359/845 |
| 10,648,626 | B2 * | 5/2020 | Hwang | F21S 43/40 |
| 2004/0051948 | A1 * | 3/2004 | Reed | B29C 43/222 359/529 |
| 2005/0259438 | A1 | 11/2005 | Mizutani et al. | |
| 2008/0186726 | A1 | 8/2008 | Okada | |
| 2012/0314439 | A1 * | 12/2012 | Uchida | F21S 41/151 362/512 |
| 2013/0155707 | A1 * | 6/2013 | Mudra | H01K 1/14 362/487 |
| 2013/0294101 | A1 | 11/2013 | Brendle | |
| 2015/0055328 | A1 | 2/2015 | Irii et al. | |
| 2016/0018066 | A1 * | 1/2016 | Abele | B29D 11/00605 362/84 |
| 2017/0153000 | A1 * | 6/2017 | Sato | F21S 41/153 |
| 2017/0321865 | A1 | 11/2017 | Parker et al. | |
| 2017/0350572 | A1 | 12/2017 | Yoo et al. | |
| 2018/0216795 | A1 * | 8/2018 | Groenewald | F21S 43/245 |

FOREIGN PATENT DOCUMENTS

| | | |
|---|---|---|
| CN | 102959320 | 3/2013 |
| CN | 204062781 | 12/2014 |
| CN | 204494253 | 7/2015 |
| CN | 105805671 | 7/2016 |
| CN | 205592823 | 9/2016 |
| CN | 107504424 | 12/2017 |
| CN | 207122864 | 3/2018 |
| DE | 102004038065 | 3/2005 |
| EP | 2147745 | 1/2010 |
| JP | 4218493 | 11/2008 |
| WO | WO 2017/088447 | 6/2017 |

OTHER PUBLICATIONS

First Search of Priority Document of CN201810150455.X in 2 pages.
Supplemental Search from Priority Document of CN201810150455.X in 1 page.
First Office Action from Chinese App No. CN201810150455.X dated Mar. 18, 2019 in 13 pages.
Second Office Action from Chinese App No. CN201810150455.X dated Oct. 11, 2019 in 12 pages.
Third Office Action from Chinese App No. CN201810150455.X dated Apr. 1, 2020 in 13 pages.
Fourth Office Action from Chinese App No. CN201810150455.X dated Nov. 18, 2020 in 5 pages.
First Office Action from German App. No. DE112018000003.6 dated Mar. 22, 2019 in 5 pages.
Second Office Action from German App No. DE112018000003.6 dated Mar. 19, 2020 in 5 pages.

* cited by examiner

VEHICLE LAMP SYSTEM, VEHICLE LAMP, AND METHOD FOR MANUFACTURING VEHICLE LAMP SYSTEM

CROSS-REFERENCE TO RELATED APPLICATIONS

This application is a 371 U.S. National Phase of International application No. PCT/CN2018/085661, filed May 4, 2018, published as WO 2019/157781, claiming benefit/priority of Chinese Patent Application No. 201810150455.X, filed Feb. 13, 2018, the entire contents of all of which are incorporated herein by reference.

TECHNICAL FIELD

The present disclosure relates to the technical field of automobile lighting, and in particular, to a vehicle lamp system, a vehicle lamp, and a method for manufacturing a vehicle lamp system.

BACKGROUND ART

With the rapid development of the automobile industry, the field of automobile parts has also made remarkable progress, wherein the technical progress is particularly notable in vehicle lamp which serves as an important part with which each automobile needs to be equipped.

At present, with the continuous advancement of vehicle lamp technologies, not only vehicle lamps must meet the requirements of test values at test points under the laws and regulations, but also more and more vehicle manufacturers are demanding the uniformity of light from vehicle lamps. The vehicle lamps currently available on the market generally comprise LED light emitting chips and a light distribution lens. Light emitted from a light source reaches a light distribution lens of scattering material and then is scattered, and the uniformly distributed LED light emitting chips enable the light distribution lens of scattering material to achieve uniform light emission within a certain angle range. However, since the LED light emitting chip has such a light emitting characteristic that the light intensity is gradually weakened as the included angle between the outgoing light and an optical axis direction (i.e., the direction normal to the light emitting surface of the LED light emitting chip) increases, a dark area may appear in a middle of the portion of the scattering material facing two adjacent LED light emitting chips, resulting in a decrease in the uniformity of light beams. Moreover, due to the limited beam angle under half of maximal light intensity of the scattering material, the lamp light uniformity is restricted such that the range is generally not beyond a range of 30 degrees from the direction of the optical axis of the LED light emitting chip, thus the lamp light uniformity will be greatly reduced when observed at a large angle.

SUMMARY

The present disclosure provides a vehicle lamp system to improve the problem of insufficient light uniformity.

The present disclosure also provides a vehicle lamp to improve the problem of insufficient light uniformity.

The present disclosure also provides a method for manufacturing a vehicle lamp system based on the vehicle lamp system described above, so as to increase the uniformity of light illuminating.

The present disclosure is implemented as follows:

Embodiments of the present disclosure provide a vehicle lamp system. The vehicle lamp system comprises a light reflective element and at least one light source, the light source is disposed opposite to the light reflective element, and the light reflective element is configured to diffusely reflect the light emitted from the light source to achieve uniform illumination.

Further, the light reflective element comprises a light reflective element of an anisotropic material.

Further, the light reflective element of an anisotropic material comprises a light reflective plate provided with multiple wire-drawings (lines formed by processing a surface of a workpiece with a grinding product or the like).

Further, the multiple wire-drawings are disposed in parallel in a length direction of the light reflective plate.

Further, spacings between adjacent wire-drawings are equal to each other.

Further, the shape of the wire-drawing comprises any one of a straight line, a curved line and a circle.

Further, the wire-drawings are formed by flat-pressing drawing using an abrasive belt or formed by drawing using a nonwoven roller brush.

Further, the light reflective plate comprises a metallic light reflective plate or a plastic light reflective plate.

Further, the light reflective plate is a stainless steel plate.

Further, the light reflective element comprises a light reflective mirror provided with multiple diffuse reflection points.

Further, the diffuse reflection point is a bump disposed on a mirror surface of the light reflective mirror.

Further, a longitudinal section of the bump is semicircular.

Further, the vehicle lamp system further comprises a light distribution lens, and light beams emitted from the light source are transmitted to the light distribution lens after being diffusely reflected by the light reflective element.

Further, the light source comprises multiple LED light emitting chips, wherein the multiple LED light emitting chips are arranged in an array.

Further, the spacing between two adjacent LED light emitting chips is greater than 15 mm.

Embodiments of the present disclosure also provide a vehicle lamp, comprising a vehicle lamp system, wherein the vehicle lamp system comprises a light reflective element and at least one light source, the light source is disposed opposite to the light reflective element, and the light reflective element is configured to diffusely reflect the light emitted from the light source to achieve uniform illumination.

Embodiments of the present disclosure also provide a method for manufacturing a vehicle lamp system, the method for manufacturing a vehicle lamp system is based on the vehicle lamp system described above.

The method for manufacturing a vehicle lamp system comprises the following steps of:

disposing a light reflective plate having a light reflective surface; and disposing the light source opposite to the light reflective element, wherein multiple wire-drawings are disposed on the light reflective surface, so that light beams emitted from the light source are diffusely reflected by the wire-drawings and the light reflective plate.

Further, the wire-drawings extend in a width direction of the light reflective surface.

Further, the multiple wire-drawings are disposed in parallel in a length direction of the light reflective surface.

Further, spacings between adjacent wire-drawings are equal to each other.

The beneficial effects of the present disclosure include:

The present disclosure provides a vehicle lamp system and a vehicle lamp, wherein the vehicle lamp system comprises a light reflective element and at least one light source, the light source is disposed opposite to the light reflective element, and the light reflective element is used for diffusely reflecting the light emitted from the light source. Since the vehicle lamp system provided in the present disclosure is able to diffusely reflect the light emitted from the light source by the light reflective element, the light beams is able to be reflected by the light reflective element toward different directions, so that the purpose of reflecting the light beams in various directions can be accomplished without the need to use light distribution lens, thereby enhancing the uniformity of the light beams.

In order to enable the above described objects, features, and advantages of the present disclosure to be more apparent and easily understood, preferred embodiments will be described in detail in the following by way of example with reference to the accompanying drawings.

BRIEF DESCRIPTION OF DRAWINGS

In order to make the objects, technical solutions and advantages of the embodiments of the present disclosure clearer, the technical solutions of the embodiments of the present disclosure will be described below clearly and completely with reference to the drawings in the embodiments of the present disclosure. It is apparent that the embodiments to be described are some, but not all of the embodiments of the present disclosure. Generally, the components of the embodiments of the present disclosure, as described and illustrated in the figures herein, may be arranged and designed in a wide variety of different configurations. Thus, the following detailed description of the embodiments of the present disclosure, as represented in the figures, is not intended to limit the protection scope of the present disclosure as claimed, but is merely representative of selected embodiments of the present disclosure. All the other embodiments obtained by those of ordinary skill in the art in light of the embodiments of the present disclosure without inventive efforts would fall within the protection scope of the present disclosure.

Figure 1:
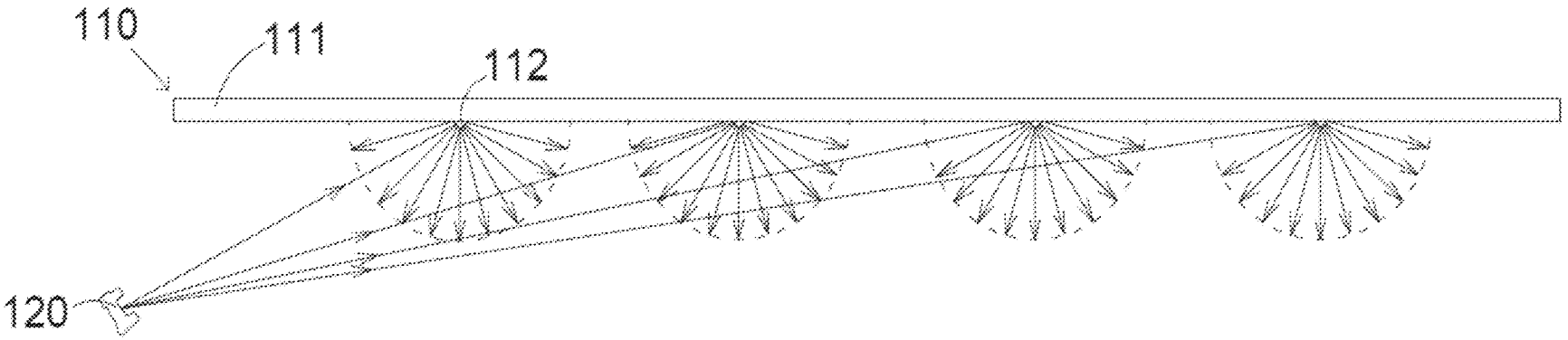
FIG. 1 shows a schematic structural diagram of a vehicle lamp system provided in embodiments of the present disclosure.

Reference numerals: 100—vehicle lamp system 110—light reflective element 111—light reflective plate 112—wire-drawing 113—light reflective mirror 114—diffuse reflection point 120—light source 130—light distribution lens.

DETAILED DESCRIPTION OF EMBODIMENTS

The technical solutions in the embodiments of the present disclosure will be described below clearly and completely with reference to the drawings in the embodiments of the present disclosure. It is apparent that the embodiments to be described are some, but not all of the embodiments of the present disclosure. Generally, the components of the embodiments of the present disclosure, as described and illustrated in the figures herein, may be arranged and designed in a wide variety of different configurations. Thus, the following detailed description of the embodiments of the present disclosure, as represented in the figures, is not intended to limit the protection scope of the present disclosure as claimed, but is merely representative of selected embodiments of the present disclosure. All the other embodiments obtained by those skilled in the art in light of the embodiments of the present disclosure without inventive efforts would fall within the protection scope of the present disclosure.

In the description of the present disclosure, it should also be noted that unless otherwise expressly specified or defined, terms "provided", "mounted", "coupled", and "connected" should be understood in a broad sense. For example, connection may be fixed connection or detachable connection or integral connection, may be mechanical connection or electric connection, or may be direct coupling or indirect coupling via an intermediate medium or internal communication between two elements. The specific meanings of the above-mentioned terms in the present disclosure could be understood by those of ordinary skill in the art according to specific situations.

It should be noted that similar reference numerals and letters refer to similar items in the following figures, and thus once a certain item is defined in one figure, it does not need be further defined or explained in the following figures.

Some embodiments of the present disclosure will be described in detail below with reference to the drawings. The following embodiments and features in the embodiments can be combined with one another without conflict.

First Embodiment

Referring to FIG. 1, the embodiment of the present disclosure provides a vehicle lamp system 100. The vehicle lamp system 100 comprises a light reflective element 110 and at least one light source 120. Light emitted from the light source 120 provides illumination for a driver after being diffusely reflected by the light reflective element 110.

In practical use, the driver will turn on the vehicle lamp according to the situations. The vehicle lamp comprises illumination lamps and signal lamps. One form of the vehicle lamps generally comprises a light source 120 and a light distribution lens. Light beams emitted from the light source 120 are scattered by the light distribution lens, so that the light beams are transmitted in various directions. However, the light distribution lens generally has a small beam angle under half of maximal light intensity. For example, a light distribution lens made of PMMA df23 8N milky white scattering material has a beam angle under half of maximal light intensity of only 19 degrees, that is to say, the intensity of the scattered light is half that of the incident light when the incident light angle is 19 degrees, in other words, only when observed in a relatively small range, the uniformity of the lamp light can be maintained, and the lamp light uniformity will be reduced when observed at a large angle.

Figure 2:
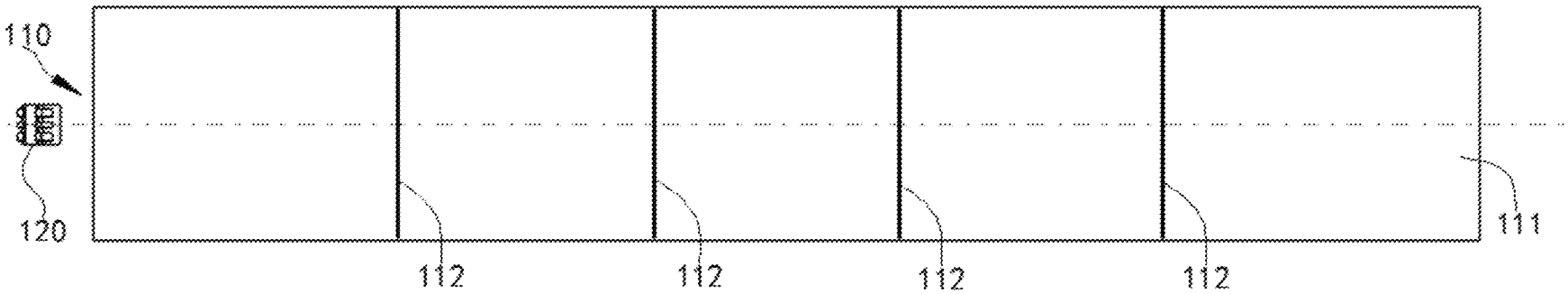
FIG. 2 is a schematic structural diagram of FIG. 1 from another angle of view.

FIG. 2 is a schematic structural diagram of FIG. 1 from another angle of view.

In view of this, referring to FIG. 1 and FIG. 2, in the present embodiment, a light reflective element 110 is disposed in order to enhance the light uniformity. The light reflective element 110 is able to diffusely reflect the light emitted from the light source 120, and the diffusely-reflected light beams have the same intensity in various directions, therefore the uniformity of lamp light is able to be enhanced in a relatively wide observation range.

In the present embodiment, a light reflective element 110 made of an anisotropic material is used. The anisotropic material refers to a material having a relatively large diffusion angle for reflected light in a certain direction, i.e., being capable of achieving diffuse reflection of light beams. Of course, in some other embodiments, the light reflective element 110 may also be made of other materials, which is not limited in any way in the present embodiment.

Further, in the present embodiment, a light reflective plate 111 provided with multiple wire-drawings 112 is used as the light reflective element 110 of an anisotropic material. Here, the wire-drawing 112 refers to a shallow texture formed on the surface of the light reflective plate 111 after drawing treatment is performed. The common mechanical wire-drawings 112 comprise wire-drawings 112 formed by flat-pressing drawing using an abrasive belt or a wire-drawings 112 formed by drawing using a non-woven roller brush.

Optionally, the multiple wire-drawings are disposed in parallel in a length direction of the light reflective plate. In this way, the uniformity of light beams emitted from the light reflective element 110 is ensured. Further, spacings between adjacent wire-drawings are equal to each other. The equally spaced wire-drawings are able to emit light beams in a better manner to adjust the uniformity of the lamp light.

It should be pointed out that in other embodiments of the present disclosure, the multiple wire-drawings may not all be disposed in parallel, and spacings between the adjacent wire-drawings may not all be equal, as long as the light source coordinates and cooperates with the light reflective plate and the wire-drawings, to achieve enhancement of the uniformity of the lamp light.

Since the wire-drawing 112 has the effect that the wire-drawing 112 is able to reflect light beams in a direction perpendicular to the wire-drawing 112, and that the wire-drawing 112 is able to achieve diffuse reflection of light beams in a direction parallel to the wire-drawing 112, the light beams are uniformly diffused to accomplish an effect of enhancing the light uniformity.

It should be noted that the scattering angle formed by the process of surface wire-drawing 112 depends on the shape of the cross section of the wire-drawing 112, the depth of the wire-drawing 112, and the density of the wire-drawings 112. In the present embodiment, the shape of the wire-drawing 112 may be a shape such as a straight line, a curved line, a circle, or the like. Of course, wire-drawings 112 of other shapes, such as a triangle or a semicircle, may also be used. The density of the wire-drawings 112 refers to the number of the cross sections per unit length or the spacing between adjacent wire-drawings 112. The depth of the wire-drawing 112 refers to a distance between a base surface of the metallic light reflective plate 111 and the bottom of the wire-drawing 112. Moreover, different scattering angles may be formed in different directions of wire-drawings 112, and working personnel may select wire-drawings 112 matching the scattering angles according to actual requirements. By disposing the wire-drawings 112 on the light reflective plate 111, the effect of enhancing the uniformity of lamp light is able to be achieved by the diffuse reflection by the wire-drawings 112 after the light is emitted from the light source 120.

Meanwhile, it should also be noted that in practical applications, since many materials may be used to form the wire-drawing 112, the light reflective plate 111 in the present embodiment may be a metallic light reflective plate 111 or a plastic light reflective plate 111 in order to achieve processing of the wire-drawing 112 on the light reflective plate 111. The wire-drawing 112 can be formed on the metallic light reflective plate 111 or the plastic light reflective plate 111 by processing the metallic light reflective plate 111 or the plastic light reflective plate 111.

Further, in the present embodiment, the light reflective plate 111 is a stainless steel plate.

It can be understood that in other embodiments of the present disclosure, the wire-drawing may also be obtained by processing other materials, which is not limited in any way in the present embodiment.

Meanwhile, it should also be noted that in the present embodiment, the light source 120 comprises multiple LED light emitting chips, and the multiple LED light emitting chips are arranged in an array.

Figure 3:
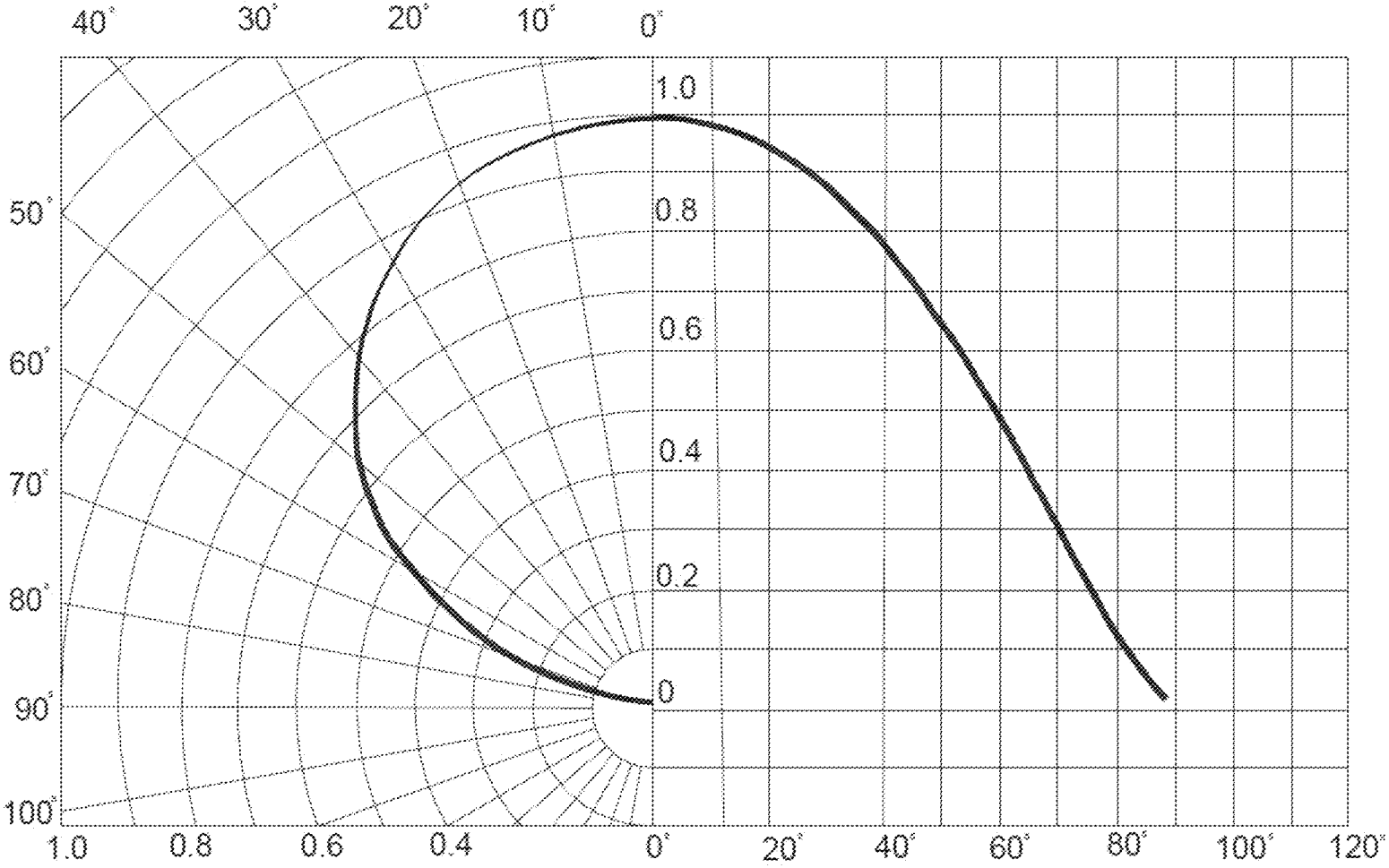
FIG. 3 shows a graph of the relation between an LED light emitting chip provided in embodiments of the present disclosure and a light emitting angle.

Referring to FIG. 3, in FIG. 3, a vertical axis marked with scales represents a luminous intensity (light intensity); a bottom side of a rectangular frame at the left side of the axis representing the luminous intensity also represents the luminous intensity, and the remaining two adjacent sides of the rectangular frame jointly represent an included angle between the outgoing light and the optical axis. In FIG. 3, a rectangular frame at the right side of the vertical axis representing the luminous intensity also shows the relation between the luminous intensity and the included angle of the outgoing light and the optical axis. As can be seen from the figure, the LED light emitting chip has the following light emitting characteristics: the luminous intensity is the strongest (the light intensity value is 1.0) in the direction of its optical axis, that is, a direction normal to the light emitting surface of the LED light emitting chip, that is, at 0 degree as shown in FIG. 3 (the angle between the outgoing light and the optical axis is 0°), and the light intensity is continuously weakened as the angle between the outgoing light and the optical axis increases, until the luminous intensity is 0 when the angle between the outgoing light and the optical axis is 90°.

Therefore, the spacing between uniformly arranged LED light emitting chips of the current vehicle lamp system 100 cannot be too large, otherwise, a dark area will appear in the middle of the portion of the scattering material facing two adjacent LED light emitting chips, resulting in a decrease in uniformity. The spacing between two adjacent LED light emitting chips ranges generally from 10 mm to 15 mm.

In contrast, in the present embodiment, light beams emitted from the LED light emitting chips are able to be diffusely reflected by the wire-drawings 112, so that the light intensity in each direction is the same. On the one hand, in the vehicle lamp system 100 provided in the present embodiment, the spacing between two LED light emitting chips is able to be increased. The spacing between two LED light emitting chips provided in the present embodiment is greater than 15 mm, and for example, the spacing between two LED light emitting chips is set to be 20 mm, so that the number of the LED light emitting chips in the vehicle lamp system 100 is reduced, thereby saving costs. On the other hand, a dark area is less likely to appear between two LED light emitting chips, thereby enhancing the light uniformity. In other words, with the vehicle lamp system 100 provided in the present embodiment, lamp light uniformity over a larger angle is able to be achieved with fewer LED light emitting chips.

Of course, in some other embodiments, in order to increase the light intensity, the spacing between two LED light emitting chips may also be set to be less than or equal to 15 mm, which is not limited in any way in the present embodiment.

It should be noted that both the number of the LED light emitting chips provided in the present embodiment and the relative positions of the LED light emitting chips with respect to the light reflective plate 111 are not specifically limited. Since the LED light emitting chips emit light in the form of a point light source 120, light beams emitted from the LED light emitting chips are always able to be diffusely reflected by the light reflective plate 111.

Figure 4:
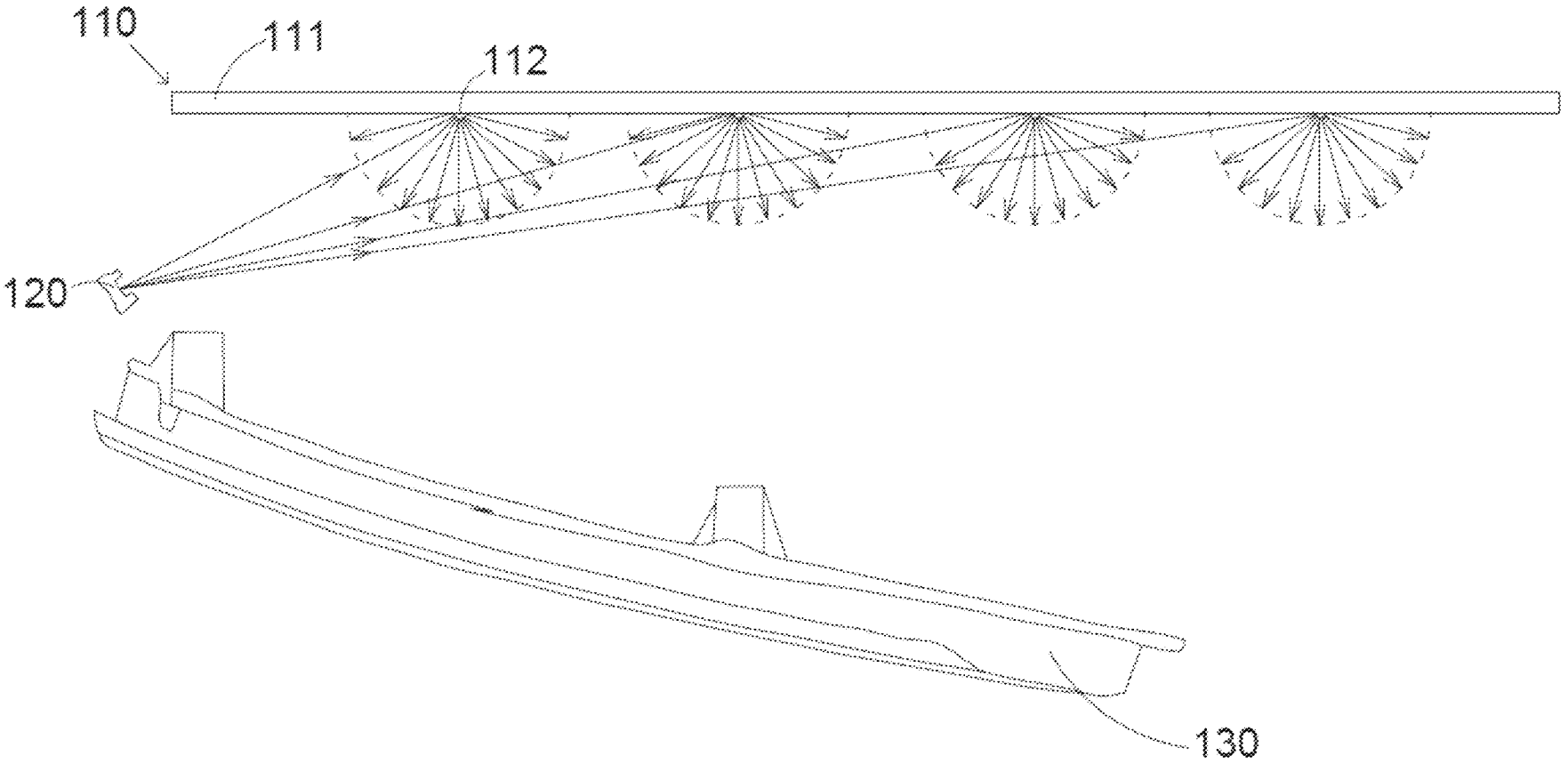
FIG. 4 shows a schematic structural diagram of a vehicle lamp system comprising a light distribution lens provided in embodiments of the present disclosure.

It should also be noted that referring to FIG. 4, in the present embodiment, the vehicle lamp system 100 also comprises a light distribution lens 130. The light beams emitted from the light source 120 are diffusely reflected by the light reflective element 110 and then transmitted to the light distribution lens 130, and subsequently scattered by the light distribution lens 130 and then continuously transmitted, so as to achieve illumination. On the one hand, the light distribution lens 130 is able to scatter light beams there to enhance the uniformity of the light beams. On the other hand, the light distribution lens 130 is also able to give some protection to the light source 120 and the light reflective element 110 so as to make the vehicle light system 100 more durable.

Second Embodiment

The embodiment of the present disclosure provides another vehicle lamp system 100. The vehicle lamp system 100 comprises a light reflective element 110 and at least one light source 120. Light emitted from the light source 120 provides illumination for a driver after being diffusely reflected by the light reflective element 110. The light reflective element 110 is able to diffusely reflect the light emitted from the light source 120, and the diffusely reflected light beams have the same intensity in various directions, therefore, the uniformity of the light is able to be enhanced in a relatively wide observation range.

Figure 5:
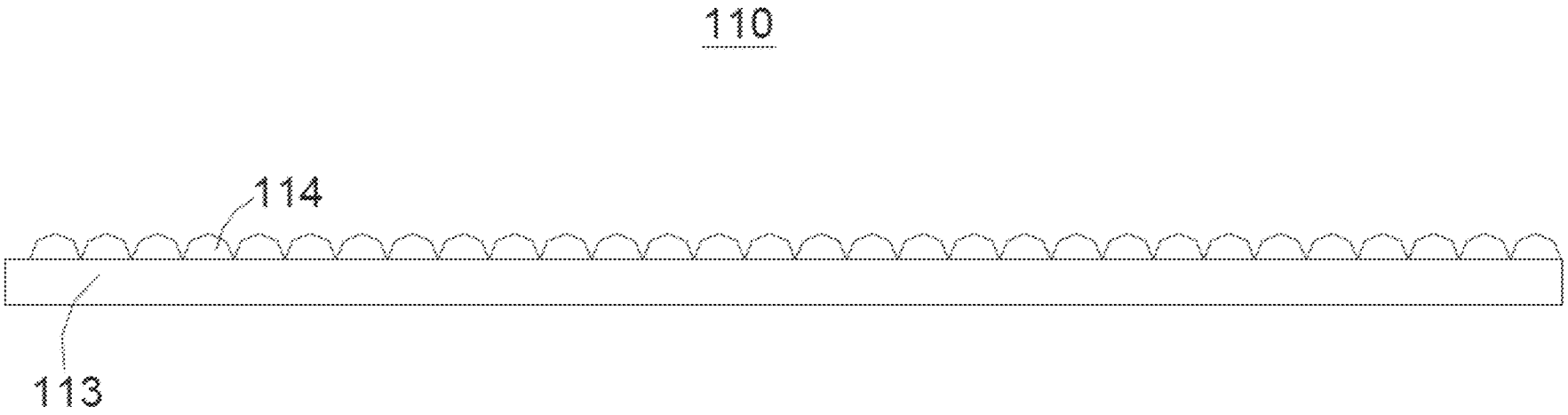
FIG. 5 shows a schematic structural diagram of a light reflective element provided in embodiments of the present disclosure.

Referring to FIG. 5, the light reflective element 110 provided in the present embodiment is a light reflective mirror 113 provided with multiple diffuse reflection points 114. After light beams emitted from the light source 120 passes the diffuse reflection points 114, the light beams will be diffusely reflected by the diffuse reflection points 114, so that the light beams are uniformly diffused to accomplish the effect of enhancing the lamp light uniformity.

Further, in the present embodiment, the diffuse reflection point 114 is a bump disposed on the mirror surface. In order to better accomplish the effect of diffusely reflecting the light beams, in the present embodiment, the diffuse reflection point 114 is disposed as a bump having a semicircular longitudinal section. In other words, the entire light reflective mirror 113 is provided with multiple bumps each having a semicircular longitudinal section, and the surface of the bump is also a mirror surface. When the light beams are transmitted to the semicircular bump, the semicircular bump is able to uniformly reflect the light beams in different directions so as to accomplish the diffuse reflection effect and enhance the light uniformity. Of course, in some other embodiments, the shape of the diffuse reflection point 114 may also be other shapes, which is not limited in any way in the present embodiment.

As can also be seen from the figure, the multiple bumps are uniformly arranged in a length direction of the light reflective mirror 113. In this way, the reflection effect of the light reflective element 110 is increased, so that the light beams are uniformly diffused to accomplish the effect of enhancing the light uniformity.

Meanwhile, in the present embodiment, the light source 120 comprises multiple LED light emitting chips, and the multiple LED light emitting chips are arranged in an array. It should be noted that the LED light emitting chip has the following light emitting characteristics: the luminous intensity is the strongest in the direction of its optical axis, that is, a direction normal to the light emitting surface of the LED light emitting chip, that is, at 0 degree as shown in FIG. 3, and the light intensity is continuously weakened as the angle between the outgoing light and the optical axis increases. Therefore, the spacing between uniformly arranged LED light emitting chips of the current vehicle lamp system 100 cannot be too large, otherwise, a dark area will appear in the middle of the portion of the scattering material facing two adjacent LED light emitting chips, resulting in a decrease in uniformity. The spacing between two adjacent LED light emitting chips ranges generally from 10 mm to 15 mm.

In contrast, in the present embodiment, light beams emitted from the LED light emitting chips are able to be diffusely reflected by the diffuse reflection points 114, so that the light intensity in each direction is the same. On the one hand, in the vehicle lamp system 100 provided in the present embodiment, the spacing between two LED light emitting chips is able to be increased. The spacing between two LED light emitting chips provided in the present embodiment is greater than 15 mm, and for example, the spacing between two LED light emitting chips is set to be 20 mm, so that the number of the LED light emitting chips in the vehicle lamp system 100 is reduced, thereby saving costs. On the other hand, a dark area is less likely to appear between two LED light emitting chips, thereby enhancing the light uniformity. In other words, with the vehicle lamp system 100 provided in the present embodiment, lamp light uniformity can be achieved in a larger observation angle with fewer LED light emitting chips. Of course, in some other embodiments, in order to increase the light intensity, the spacing between two LED light emitting chips may also be set to be less than or equal to 15 mm, which is not limited in any way in the present embodiment.

It should be noted that both the number of the LED light emitting chips provided in the present embodiment and the relative positions of the LED light emitting chips with respect to the light reflective mirror 113 are not specifically limited. Since the LED light emitting chips emit light in the form of a point light source 120, light beams emitted from the LED light emitting chips are always able to be diffusely reflected by the light reflective mirror 113.

Third Embodiment

The embodiment of the present disclosure also provides a vehicle lamp (not shown) comprising the vehicle lamp system 100 described in the first embodiment or the second embodiment. With the vehicle lamp provided in the present embodiment, when the driver is driving the vehicle, light beams emitted from the vehicle lamp are able to have better uniformity, so that the even if the vehicle lamp is observed within a wider range of angle, all the intensities of the light beams emitted from the vehicle lamp are able to meet the demands.

In summary, the present disclosure provides a vehicle lamp system and a vehicle lamp, the vehicle lamp system comprises a light reflective element and at least one light source, the light source is disposed opposite to the light reflective element, and the light reflective element is configured to diffusely reflect the light emitted from the light source. Since the vehicle lamp system provided in the present disclosure is able to diffusely reflect the light emitted from the light source by the light reflective element, the light beams are able to be reflected toward different directions after passing the light reflective element, so that the purpose of reflecting the light beams in various directions can be accomplished without the need of using the light distribution lens, thereby enhancing the uniformity of the light beams.

The embodiment of the present disclosure also provides a method for manufacturing a vehicle lamp system (not shown). The method for manufacturing a vehicle lamp system is based on the vehicle lamp system described above.

The method for manufacturing the vehicle lamp system comprises the following steps of:

disposing a light reflective plate having a light reflective surface; and disposing a light source opposite to the light reflective element, wherein multiple wire-drawings are disposed on the light reflective surface, so that light beams emitted from the light source are diffusely reflected by the wire-drawings and the light reflective plate.

It should be noted that the wire-drawing 112 refers to a shallow texture formed on the surface of the light reflective plate 111 after drawing treatment is performed. The common mechanical wire-drawing 112 comprises a wire-drawing 112 formed by flat-pressing drawing using an abrasive belt or a wire-drawing 112 formed by drawing using a non-woven roller brush.

Optionally, the multiple wire-drawings extend in a width direction of the light reflective surface. Further, the multiple wire-drawings are disposed in parallel in a length direction of the light reflective plate. In this way, the uniformity of light beams emitted from the light reflective element 110 is ensured.

Further, spacings between adjacent wire-drawings are equal to each other. The equally spaced wire-drawings are able to emit light in a better manner to adjust the uniformity of the light.

It should be pointed out that in other embodiments of the present disclosure, the multiple wire-drawings may not all be disposed in parallel, and spacings between the adjacent wire-drawings may not all be equal to each other, as long as the light source coordinates and cooperates with the light reflective plate and the wire-drawings to achieve enhancement of the uniformity of the light.

Since the wire-drawing 112 has the effect that the wire-drawing 112 is able to reflect light beams in a direction perpendicular to the wire-drawing 11, and that the wire-drawing 112 is able to achieve diffuse reflection of light beams in a direction parallel to the wire-drawing 112, the light beams are uniformly diffused to accomplish enhancement of the light uniformity.

The vehicle lamp system manufactured by such a method for manufacturing a vehicle lamp system emits light in a more uniform manner and has a better effect in use.

In the description of the present disclosure, it should be noted that terms such as "first", "second", and "third" are used only for distinguishing the description, and should not be understood as indicating or implying to have importance in relativity. The above description is merely illustrative of preferred embodiments of the present disclosure and is not intended to limit the present disclosure. It would be understood by those skilled in the art that various modifications and variations can be made to the present disclosure. Any modifications, equivalent alternatives, improvements and so on made within the spirit and principle of the present disclosure are to be included in the protection scope of the present disclosure.

INDUSTRIAL APPLICABILITY

The present disclosure provides a vehicle lamp system, a vehicle lamp, and a method for manufacturing a vehicle lamp system. The vehicle lamp system comprises a light reflective element and at least one light source. The vehicle lamp system is able to diffusely reflect light emitted from the light source by a light reflective element, so that the light beams are able to be reflected toward different directions after passing the light reflective element, whereby the purpose of reflecting the light beams in various directions can be accomplished without the need of using the light distribution lens, thereby enhancing the uniformity of the light beams. Such a vehicle lamp system has a simple structure, is easy to manufacture, and has significant economic benefits.

The invention claimed is:

1. A vehicle lamp system, the vehicle lamp system comprising:

a light reflective element of anisotropic material, comprising a light reflective plate with multiple wire-drawings that are disposed in parallel in a length direction of the light reflective plate, wherein adjacent wire-drawings of the multiple wire-drawings are equidistantly spaced from each other; and at least one light source;

wherein the light source is disposed opposite to the light reflective element and the light reflective element is configured to diffusely reflect light emitted from the light source to achieve uniform illumination.

2. The vehicle lamp system according to claim 1, wherein a shape of the wire-drawings comprise any one of a straight line, a curved line and a circle.

3. The vehicle lamp system according to claim 1, wherein the wire-drawings are formed by flat-pressing drawing using an abrasive belt or by drawing using a non-woven roller brush.

4. The vehicle lamp system according to claim 1, wherein the light reflective plate comprises a metallic light reflective plate or a plastic light reflective plate.

5. The vehicle lamp system according to claim 4, wherein the light reflective plate is a stainless steel plate.

6. The vehicle lamp system according to claim 1, wherein the light reflective element comprises a light reflective mirror provided with multiple diffuse reflection points.

7. The vehicle lamp system according to claim 6, wherein each diffuse reflection point is a bump disposed on a mirror surface of the light reflective mirror.

8. The vehicle lamp system according to claim 7, wherein a longitudinal section of the bump is semicircular.

9. The vehicle lamp system according to claim 1, wherein the vehicle lamp system further comprises a light distribution lens, and light beams emitted from the light source are transmitted to the light distribution lens after being diffusely reflected by the light reflective element.

10. The vehicle lamp system according to claim 1, wherein the light source comprises multiple LED light emitting chips, and the multiple LED light emitting chips are arranged in an array.

11. The vehicle lamp system according to claim 10, wherein a spacing between two adjacent LED light emitting chips of the multiple LED light emitting chips is greater than 15 mm.

12. A vehicle lamp, comprising the vehicle lamp system according to claim 1.

13. A method for manufacturing a vehicle lamp system, wherein the method for manufacturing a vehicle lamp system is based on the vehicle lamp system according to claim 1, and the method for manufacturing a vehicle lamp system comprises steps of:

disposing a light reflective plate having a light reflective surface; and disposing a light source opposite to the light reflective element, wherein multiple wire-drawings are disposed on the light reflective surface, so that light beams emitted from the light source are diffusely reflected by the wire-drawings and the light reflective plate.

14. The method for manufacturing a vehicle lamp system according to claim 13, wherein the wire-drawings extend in a width direction of the light reflective surface.

* * * * *